US010154331B2

(12) United States Patent
Houle

(10) Patent No.: US 10,154,331 B2
(45) Date of Patent: Dec. 11, 2018

(54) WIRELESS EARBUD

(71) Applicant: Phazon Inc., Shaker Heights, OH (US)

(72) Inventor: Christian Houle, Montreal (CA)

(73) Assignee: Phazon Inc., Cleveland, OH (US)

( * ) Notice: Subject to any disclaimer, the term of this patent is extended or adjusted under 35 U.S.C. 154(b) by 0 days.

(21) Appl. No.: 15/549,946

(22) PCT Filed: Feb. 10, 2016

(86) PCT No.: PCT/US2016/017295
§ 371 (c)(1),
(2) Date: Aug. 9, 2017

(87) PCT Pub. No.: WO2016/130641
PCT Pub. Date: Aug. 18, 2016

(65) Prior Publication Data

US 2018/0035192 A1 Feb. 1, 2018

Related U.S. Application Data

(60) Provisional application No. 62/114,373, filed on Feb. 10, 2015.

(51) Int. Cl.
*H04R 1/02* (2006.01)
*H04R 9/06* (2006.01)
(Continued)

(52) U.S. Cl.
CPC ..... *H04R 1/1016* (2013.01); *H04R 1/105* (2013.01); *H04R 25/652* (2013.01);
(Continued)

(58) Field of Classification Search
CPC ..... H04R 1/1016; H04R 1/105; H04R 25/02; H04R 25/652; H04R 25/60; H04R 25/65;
(Continued)

(56) References Cited

U.S. PATENT DOCUMENTS 2,248,837 A 7/1941 Walters
2,325,590 A 7/1943 Carlisle
(Continued)

FOREIGN PATENT DOCUMENTS

JP 2006 222492 A 8/2006
WO 2006/104981 A2 10/2006
WO 2010/127265 A2 11/2010

OTHER PUBLICATIONS

PCT/US2016/017295; PCT International Search Report and Written Opinion of the International Searching Authority dated May 3, 2016.

(Continued)

*Primary Examiner* — Xu Mei
(74) *Attorney, Agent, or Firm* — Renner, Otto, Boisselle & Sklar, LLP

(57) ABSTRACT

A wireless earbud including a shell housing having an inner shell portion and an outer shell portion. The inner shell portion has an inwardly facing ovate-shaped surface with a forward end portion configured to fit toward the user's ear canal, and a rearward end portion configured to fit in the concha of the user's ear. The outer shell portion has an outwardly facing surface and one or more outwardly protruding abutment surfaces configured to engage other parts of the user's ear to restrict rotation and prevent the earbud from falling out. For example, a first abutment may engage the user's tragus, a second abutment may engage the user's antitragus, and the first and second abutments may together form a convex surface that fits within the user's intertragical notch. Additional protrusions or surfaces may be provided to further improve the self-locking functionality of the earbud in the user's ear.

20 Claims, 10 Drawing Sheets

(51) Int. Cl.
*H04R 1/10* (2006.01)
*H04R 25/00* (2006.01)

(52) U.S. Cl.
CPC .. *H04R 2225/023* (2013.01); *H04R 2225/025* (2013.01); *H04R 2420/07* (2013.01)

(58) Field of Classification Search
CPC ..... H04R 25/656; H04R 2460/09; H04R 2225/023; H04R 2225/025
USPC ..... 381/315, 322, 324, 328, 380; 181/129, 181/130, 135; D14/205, 223
See application file for complete search history.

(56) References Cited

U.S. PATENT DOCUMENTS 2,430,229 A 11/1947 Kelsey
D153,747 S 5/1949 Anderson
2,521,414 A 9/1950 Schier
2,971,065 A 2/1961 Busse
3,061,689 A 10/1962 McCarrell
D206,665 S 1/1967 Sanzone
3,440,365 A 4/1969 Hazell
4,069,400 A 1/1978 Johanson
D251,234 S 3/1979 Hakansson et al.
D266,271 S 9/1982 Johanson
D276,143 S 10/1984 Williams
D287,765 S 1/1987 Topholm
D289,040 S 3/1987 Olsen
D326,855 S 6/1992 Bose et al.
D367,113 S 2/1996 Weeks
5,659,156 A 8/1997 Mauney et al.
5,692,059 A 11/1997 Kruger
D427,994 S 7/2000 Pirelli
6,122,388 A * 9/2000 Feldman ..... H04R 25/604 381/322
6,386,314 B1 5/2002 Sheehan
D468,301 S 1/2003 Fushimi
6,688,421 B2 * 2/2004 Dyer ..... A61F 11/08 181/130
6,810,987 B1 11/2004 DeKalb
6,819,762 B2 11/2004 Jones et al.
D519,487 S 4/2006 Knight
D550,657 S 9/2007 Gan
D559,837 S 1/2008 Nakano
7,356,156 B2 4/2008 Rüegg
D574,814 S 8/2008 Hammond
7,536,008 B2 5/2009 Howes et al.
D596,624 S 7/2009 Hong
7,708,110 B2 5/2010 Leong et al.
D618,219 S 6/2010 Burgett et al.
D627,337 S 11/2010 Wu
D632,677 S 2/2011 Brown
7,916,888 B2 3/2011 Sapiejewski et al.
7,965,855 B1 * 6/2011 Ham ..... H04R 1/1091 181/130
D641,010 S 7/2011 Kwon
D641,736 S 7/2011 Brunner
8,031,894 B2 * 10/2011 Perkins ..... H04R 25/652 381/328
8,069,022 B2 * 11/2011 Slabaugh ..... G06K 9/6206 381/23.1
8,111,861 B2 2/2012 Lowry
8,116,501 B2 2/2012 Kusuda et al.
8,121,325 B2 * 2/2012 Atamaniuk ..... H04M 1/05 381/322
D659,672 S 5/2012 Lee et al.
D660,292 S 5/2012 Rautiainen
D660,826 S 5/2012 Brunner
8,311,253 B2 11/2012 Silvestri et al.
D673,531 S 1/2013 Lee
D673,532 S 1/2013 Lee
D676,026 S 2/2013 Lee
8,391,526 B2 3/2013 Dahl
8,401,218 B2 3/2013 Son et al.
8,406,447 B2 3/2013 Kromann et al.
8,526,657 B2 9/2013 Yanagishita et al.
8,548,186 B2 10/2013 Alwicker
8,666,102 B2 3/2014 Bruckhoff et al.
8,731,228 B2 5/2014 Burgett et al.
8,737,669 B2 5/2014 Monahan et al.
D711,356 S 8/2014 Yang
8,873,786 B2 10/2014 Larsen et al.
D716,769 S 11/2014 Lee
D719,139 S 12/2014 Henry
8,903,114 B2 * 12/2014 Voix ..... A61F 11/08 181/135
8,976,995 B2 3/2015 Berg
8,989,426 B2 3/2015 Silvestri et al.
D735,169 S 7/2015 Shieh
9,088,846 B2 7/2015 Blanchard
9,106,996 B2 8/2015 Burgett et al.
D764,445 S 8/2016 Czaniecki
9,445,183 B2 * 9/2016 Dahl ..... H04R 1/1058
D797,079 S * 9/2017 Houle ..... D14/223
D798,843 S 10/2017 Valenzuela et al.
D799,451 S 10/2017 Ball
2006/0050912 A1 3/2006 Kidd
2006/0067556 A1 3/2006 Bailey et al.
2007/0253587 A1 11/2007 Ostrowski
2008/0013774 A1 1/2008 Hosaka et al.
2008/0025539 A1 1/2008 Bailey et al.
2008/0144877 A1 6/2008 Ham et al.
2009/0214065 A1 * 8/2009 Dahl ..... H04R 1/1008 381/328
2011/0002498 A1 1/2011 Wong et al.
2011/0155147 A1 6/2011 McIntosh
2011/0255729 A1 10/2011 Tan et al.
2012/0027242 A1 2/2012 Son et al.
2012/0039500 A1 2/2012 Silvestri et al.
2012/0087532 A1 4/2012 Yang
2012/0155692 A1 6/2012 Chen
2013/0177193 A1 7/2013 Orzel et al.
2013/0343595 A1 12/2013 Zorkendorfer et al.
2014/0211977 A1 7/2014 Armstrong
2014/0286515 A1 * 9/2014 Bone ..... H04R 1/1016 381/328
2017/0094384 A1 * 3/2017 Trainer ..... H04R 1/105

OTHER PUBLICATIONS

PCT/US2016/017295; PCT International Preliminary Report on Patentability dated Aug. 24, 2017.

* cited by examiner

WIRELESS EARBUD

RELATED APPLICATIONS

This application is a national phase of International Application No. PCT/US2016/017295 filed Feb. 10, 2016 and published in the English language, which claims priority to U.S. Provisional Patent Application No. 62/114,373 filed Feb. 10, 2015, all of which are hereby incorporated herein by reference in their entireties.

FIELD OF INVENTION

The present invention relates generally to wireless earbuds, and more particularly to wireless earbuds providing improved fitment.

BACKGROUND

Current earbuds for listening to audio typically have electrical wiring connecting the earbud to a phone or other media device. The earbud wiring tethers the user to the phone or media device and encumbers movement when performing physical activities. If the earbud wiring becomes entangled or is snagged, the earbud can be ripped out of the user's ear causing possible harm.

In addition, typical earbuds commonly use compressible inserts, such as elastic grommets placed over an audio port, which are compressed and inserted deeply into the user's ear canal in order to keep the earbud in place. Such compressible inserts may cause auditory isolation of the user's surroundings, which can be dangerous if the user cannot hear possible hazards around them. In addition, since these inserts are typically deeply inserted and supported by the user's ear canal, they become uncomfortable after extended periods of use and may fill with cerumen. These typical earbuds are not usually supported by other parts of the ear, and therefore may require different sizes of interchangeable inserts to achieve proper in-the-ear fitment for different users. Further still, these typical earbuds may require additional support structures coupled to the earbud, such as spring-like arms or over-the ear supports, to keep the earbud properly positioned in the user's ear.

SUMMARY OF INVENTION

The present invention provides a wireless earbud having an inner surface adapted to fit in the concha of a user's ear, and one or more outer abutments configured to engage other parts of the user's ear, which restricts movement and prevents the earbud from falling out of the ear, and improves the comfort and fitment of the earbud in the user's ear.

The exemplary earbud may have an ovate-shaped inner surface having a narrower forward end configured to fit toward the user's ear canal, and a wider rearward end configured to overlie the concha of the user's ear. The inner surface may also be curved and inclined to contour to the general shape of the user's concha so as to further improve the fitment and comfort of the earbud in the user's ear.

In addition, the outer surface may include one or more outwardly protruding abutments that cooperate with each other, or with other outer surfaces, to help anchor the earbud in the user's ear. For example, a first abutment may engage the user's tragus, a second abutment may engage the user's antitragus, and the first and second abutments may together form a convex surface configured to fit within the user's intertragical notch. In addition, a third abutment may be provided that has a rearward ridge configured to engage an underlying region of the user's antihelix. Furthermore, the third abutment and the second abutment may together form a concave surface configured to be disposed about the user's antitragus. Additional protrusions and/or other outer surfaces may be provided to further improve the self-locking functionality of the earbud in the user's ear.

Such configuration(s) of the exemplary earbud may improve fitment in the typical user's ear, and preferably provides a one-size-fits-all earbud having universal fitment in the majority of users' ears.

In exemplary embodiments, the wireless earbud does not use elastic grommets that compress deeply into the user's ear canal, and instead the exemplary earbud preferably includes an audio protrusion on the ovate-shaped inner surface that is configured to provide improved comfort to the user over a longer period of time.

In addition, in exemplary embodiments the wireless earbud is devoid of external wires or other external structures, such as spring-like elements or over-ear supports that extend substantially outside of the user's outer ear, and instead the exemplary earbud may have its electronic components and supporting structures completely self-contained to the earbud shell so as to improve the flexibility and enjoyment of using such a device.

According to an aspect of the invention, a wireless earbud for engaging and acoustically communicating with a user's ear includes a shell housing having an inner shell portion and an outer shell portion opposite the inner shell portion. The inner shell portion has an inwardly facing ovate-shaped surface having an ovate-shaped perimeter, the ovate-shaped surface having a narrower forward end portion configured to fit toward the user's ear canal, and a wider rearward end portion opposite the forward end portion, the rearward end portion being configured to fit in the concha of the user's ear.

Embodiments of the invention may include one or more of the following additional features separately or in combination.

For example, the outer shell portion may have an outwardly facing surface opposite the inwardly facing surface, the outwardly facing surface connecting with the inwardly facing surface at portions around the ovate-shaped perimeter, and an outwardly protruding abutment extending outwardly from the outwardly facing surface. The outwardly protruding abutment may be spaced rearwardly from the forward end portion, wherein the outwardly protruding abutment is configured to face and engage the tragus of the user's ear when the earbud is in an installed position in the user's ear.

For example, in the installed position, the inwardly facing ovate-shaped surface may be situated in the user's ear such that the rearward end portion overlies a lower region of the user's concha and underlies the user's antitragus, and the forward end portion overlies an opening of the user's ear canal and underlies the user's tragus.

The ovate-shaped perimeter of the inwardly facing ovate-shaped surface may be substantially disposed on a diverging plane that is forwardly inwardly inclined with respect to a major plane, where the major plane is generally parallel to the side of the user's face in the installed position.

The inwardly facing ovate-shaped surface may have a major portion configured to overlie the concha of the user's ear in the installed position. The major portion may be gradually curved to form a convex dome-shaped surface connecting with the ovate-shaped perimeter and configured to generally contour to a region of the concha.

The major portion may be disposed in a lower region of the concha, and preferably the inwardly facing surface does not extend upwardly beyond the crus of helix of the user's ear.

An upper or middle portion of the outwardly protruding abutment may protrude further outwardly than a lower portion of the abutment. The upper or middle portion of the outwardly protruding abutment may extend outwardly a sufficient distance such that the abutment contacts the user's tragus in the installed position.

The lower portion of the abutment may recede inwardly from the upper portion of the abutment by a sufficient distance such that the lower portion of the abutment is contained within the user's intertragical notch in the installed position.

The outer shell portion may further include a second outwardly protruding abutment extending from the outwardly facing surface. The second outwardly protruding abutment may be spaced forwardly from the rearward end portion, and the second outwardly protruding abutment may be configured to face and engage the antitragus of the user's ear when the earbud is in an installed position in the user's ear.

An upper or middle portion of the second outwardly protruding abutment may extend outwardly from the outwardly facing surface a sufficient distance such that the second abutment contacts the user's antitragus in the installed position.

A lower portion of the second abutment may recede inwardly from the upper portion of the second abutment by a sufficient distance such that the lower portion of the second abutment is contained within the user's intertragical notch in the installed position.

A lower end of the second outwardly protruding abutment may connect with a lower end of the first outwardly protruding abutment at a lower edge to define a convex surface having a vertex at the lower edge.

The convex surface may be contained within the intertragical notch of the user's ear in the installed position and may be configured to help anchor the earbud into an inward region of the intertragical notch of the user's ear.

The outer shell portion may further include a third outwardly protruding abutment extending from the outwardly facing surface.

The third outwardly protruding abutment may terminate at an outwardly extending third ridge and may be configured to engage and/or underlie the antihelix of the user's ear when the earbud is in an installed position in the user's ear.

The rearward end of the third outwardly protruding abutment may terminate at a rearward ridge. The rearward ridge may extend outside of the ovate-shaped perimeter and may be configured to engage a region of the ear underlying the antihelix to enable anchoring and restricting rotation of the earbud in the user's ear in the installed position.

A forwardly disposed end of the third abutment may connect with the upper end of the second abutment to define a concave surface. The concave surface may be configured to be disposed about the antitragus of the user's ear in the installed position.

The outer shell portion may further include a fourth outwardly protruding abutment extending from the outwardly facing surface.

The fourth outwardly protruding abutment may be upwardly inclined away from the forward end portion with respect to the major axis. A forwardly disposed end of the fourth abutment may connect with the upper end of the first abutment at a forward ridge, and the forward ridge may be configured to fit within the anterior notch of the user's ear.

The exemplary earbud may include one or more upper ridges extending upwardly with respect to the upper portion of the ovate-shaped surface. The one or more upper ridges may form a curved relief configured to cooperate with the crus of helix of the user's ear in the installed position.

According to another aspect of the invention, a wireless earbud for engaging and acoustically communicating with a user's ear includes a shell housing having an inner shell portion and an outer shell portion opposite the inner shell portion. The inner shell portion has an inwardly facing ovate-shaped surface having an ovate-shaped perimeter, the ovate-shaped surface having a narrower forward end portion configured to fit toward the user's ear canal, and a wider rearward end portion opposite the forward end portion, the rearward end portion being configured to fit in the concha of the user's ear. The outer shell portion has an outwardly facing surface opposite the inwardly facing surface, the outwardly facing surface connecting with the inwardly facing surface at portions around the ovate-shaped perimeter, and an outwardly protruding abutment extending outwardly from the outwardly facing surface. The outwardly protruding abutment is spaced rearwardly from the forward end portion, wherein the outwardly protruding abutment is configured to face and engage the tragus of the user's ear when the earbud is in an installed position in the user's ear.

According to another aspect of the invention, a wireless earbud includes a housing having an inner portion and an outer portion opposite the inner shell portion. The inner portion has an inwardly facing ovate-shaped surface having an ovate-shaped perimeter, the ovate-shaped surface being configured to fit in the concha of the user's ear. The outer portion has an outwardly facing surface opposite the inwardly facing surface. The outwardly facing surface has a first outwardly protruding abutment and second outwardly protruding abutment, the respective abutments extending from the outwardly facing surface, the first abutment connecting with the second abutment to define a convex abutment surface that is configured to fit within the user's intertragical notch when the earbud is in an installed position.

According to another aspect of the invention, a wireless earbud includes a housing having an inner portion and an outer portion opposite the inner portion. The inner portion has an inwardly facing ovate-shaped surface having an ovate-shaped perimeter, the ovate-shaped surface having a narrower forward end portion configured to fit toward the user's ear canal, and a wider rearward end portion opposite the forward end portion, the rearward end portion being configured to fit in the concha of the user's ear. The inwardly facing ovate-shaped surface has an audio cone extending inwardly toward the ear canal, the audio cone having an audio port for transmitting audible sound therethrough. An apex of the audio cone is disposed proximal a focal point of an ellipse superimposedly inscribed within the ovate-shaped perimeter, the superimposedly inscribed ellipse having a major axis aligned with the major axis of the ovate-shaped surface, the apex of the audio cone being disposed proximal the focal point of the superimposedly inscribed ellipse that is closer to the forward end portion of the ovate-shaped surface.

Embodiments of the invention may include one or more of the following additional features separately or in combination.

The superimposedly inscribed ellipse may have an eccentricity of between 0.4 and 0.7, preferably about 0.5, and the apex of the audio cone may be disposed on the major axis between the center of the superimposedly inscribed ellipse and the focal point of the superimposedly inscribed ellipse.

The audio cone may have an axis that is perpendicular to a major axis which is generally parallel to the side of the user's face when the earbud is in the installed position.

The earbud may further include a multi-faceted crown protruding outwardly from the outwardly facing surface, wherein the facets of the crown are sloped relative to a central region of the crown and terminate at respective abutment surfaces, the respective abutment surfaces being configured to restrict movement of the earbud in the installed position.

According to another aspect of the invention, a wireless earbud for engaging and acoustically communicating with a user's ear includes a generally flattened ovoid-shaped body; a cone-shaped protrusion extending outwardly from one side of the generally flattened ovoid-shaped body; and a multi-faceted crown protruding outwardly from the opposite side of the generally flattened ovoid-shaped body.

The multi-faceted crown may have a flat plateau, and the respective facets may slope from the plateau toward the generally flattened ovoid-shaped body and terminate at respective abutment surfaces, the respective abutment surfaces being configured to restrict movement of the earbud in the installed position.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention.

DETAILED DESCRIPTION

An exemplary wireless earbud includes a shell housing having an inner shell portion and an outer shell portion. The inner shell portion has an inwardly facing ovate-shaped surface with a forward end portion configured to fit toward the user's ear canal, and a rearward end portion configured to fit in the concha of the user's ear. The outer shell portion has an outwardly facing surface and one or more outwardly protruding abutment surfaces configured to engage other parts of the user's ear to restrict rotation and prevent the earbud from falling out. For example, a first abutment may engage the user's tragus, a second abutment may engage the user's antitragus, and the first and second abutments may together form a convex surface that fits within the user's intertragical notch. Additional protrusions or surfaces may be provided to further improve the self-locking functionality of the earbud in the user's ear.

Figure 4:
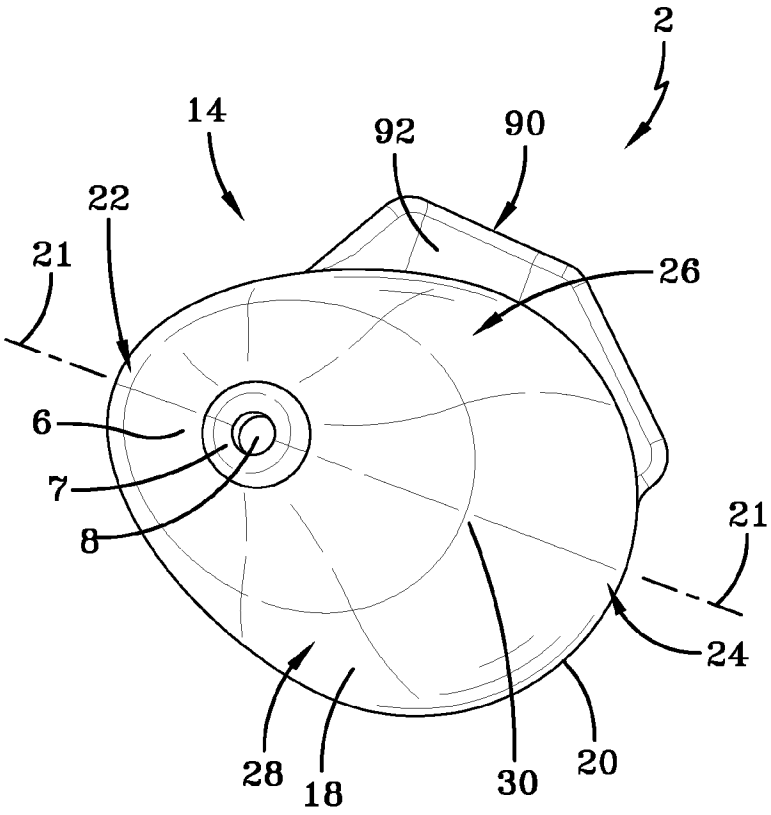
FIG. 4 is a plan view of the inner side of the earbud in FIG. 1.
Figure 3:
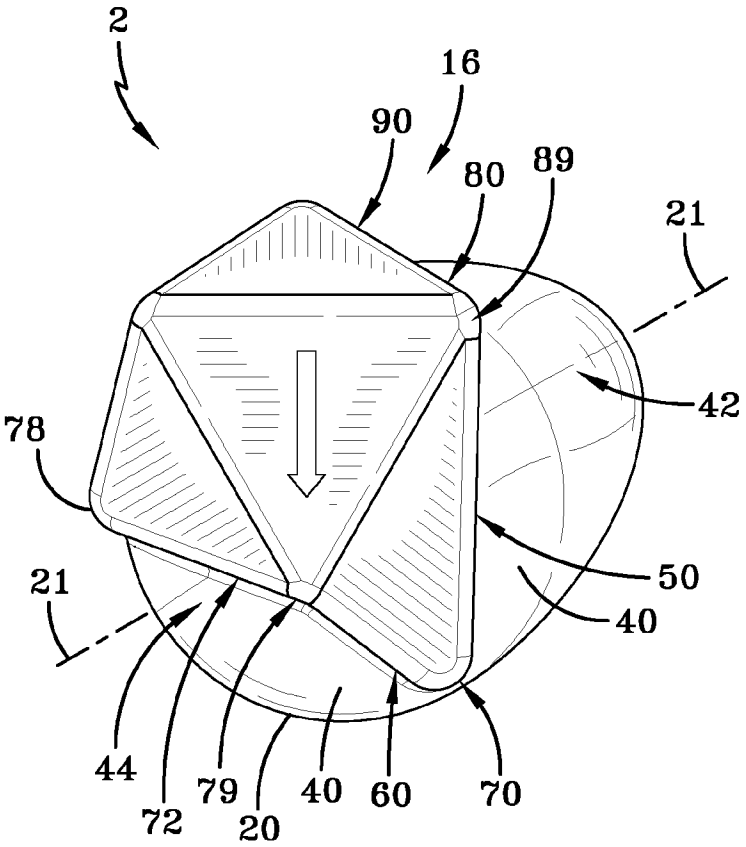
FIG. 3 is a plan view of the outer side of the earbud in FIG. 1.

In the discussion above and to follow, the terms "upward", "upper", "top", "downward", "lower", "bottom", "forward", "front", "rearward", "rear", "inward", "inner", "outward", "outer", "above", "below", etc. refer to an exemplary wireless earbud as viewed in a horizontal position, as shown in FIGS. 3 and 4, for example. This is done realizing that these earbuds, such as when placed in a package or the like, can be provided in various other positions. Furthermore, while only a right-side earbud may be shown in the drawings, it is understood that the invention also includes the left-side earbud, which is a mirror image of the right-side.

Figure 10:
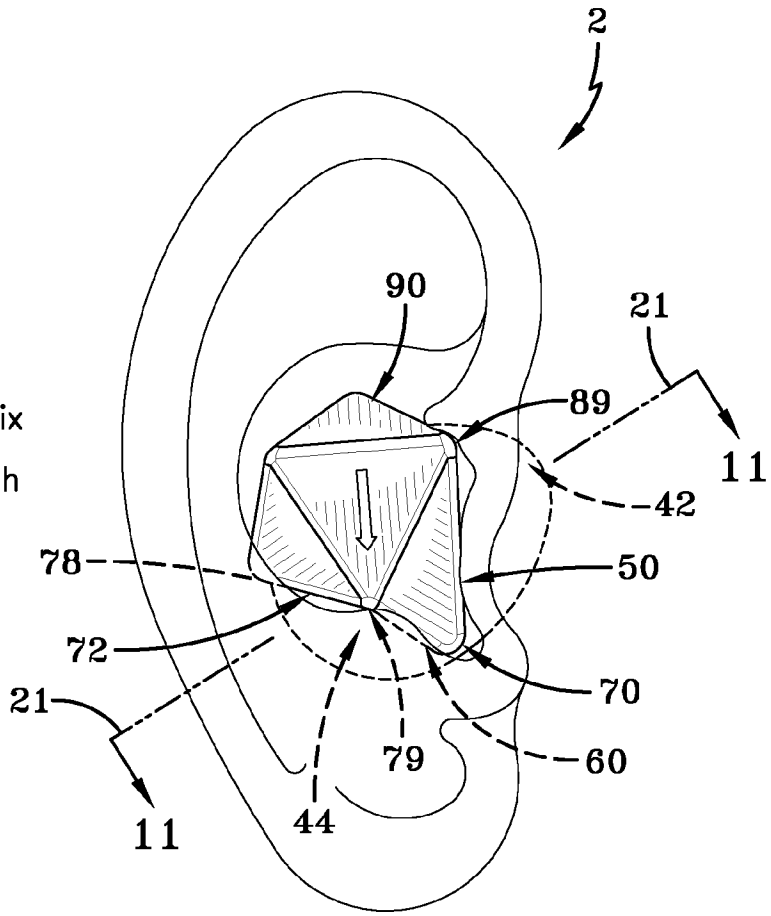
FIG. 10 is a schematic outer side view of the earbud in FIG. 1 in an installed position in the user's ear.
Figure 9:
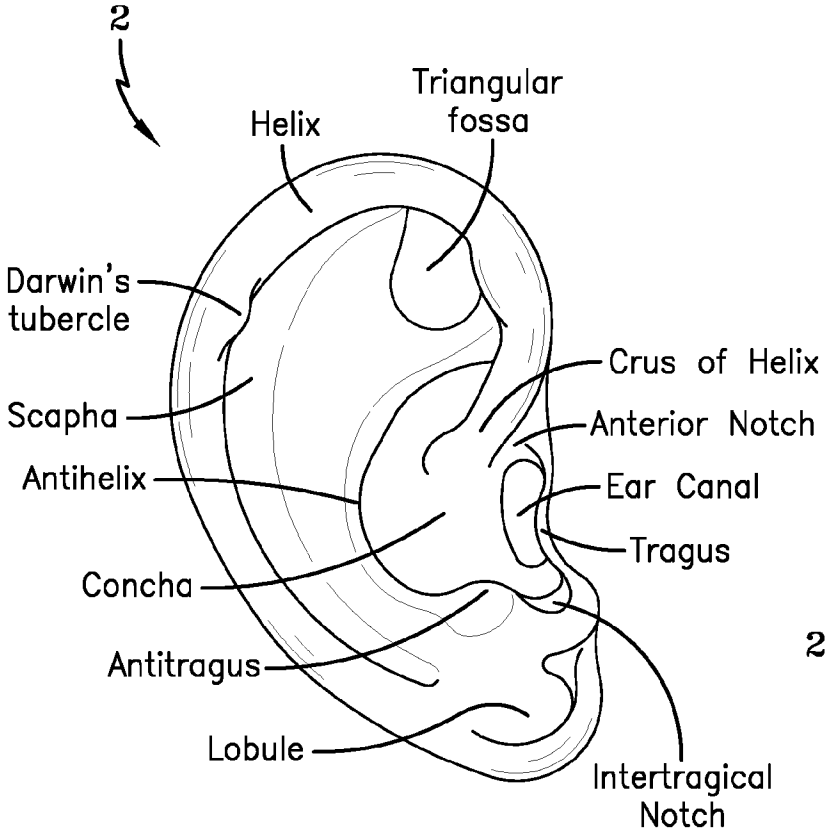
FIG. 9 is a schematic illustration of a user's ear.

In addition, reference is made to different parts of a user's ear (as shown in FIG. 9, for example) and the earbud being in an installed position in the typical user's ear (as shown in FIG. 10, for example). In this manner, the terms related to "upward" refer to the direction toward the top of the user's head, the terms related to "downward" refer to the direction toward the user's feet (as shown by the arrow in FIG. 10), the terms related to "forward" refer to the direction toward the user's nose, and the terms related to "rearward" refer to the direction toward the back of the user's head. In addition, it is understood that parts of the user's ear have regions that connect with other regions of different parts of the ear, and in this manner the exemplary earbud may engage, contact, abut, overlie, underlie, etc. a part or parts of the typical user's ear, including regions near those parts or adjacent parts, particularly considering the non-uniformity among different users' ears.

Figure 2:
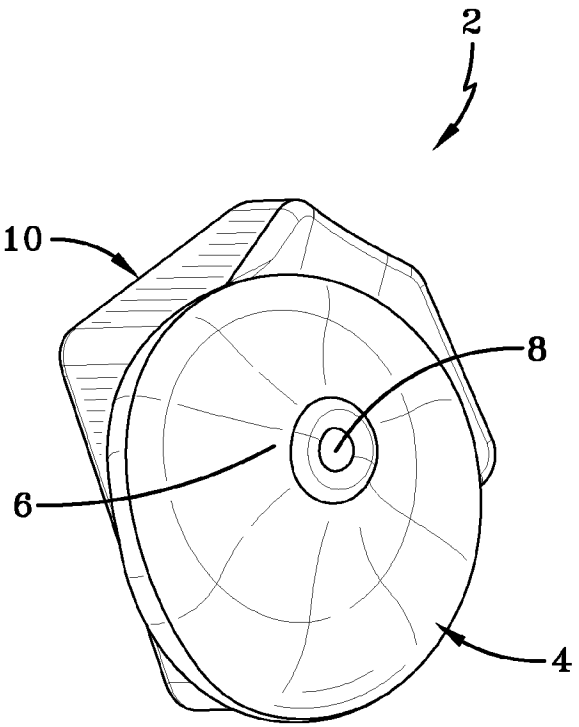
FIG. 2 is a front perspective view of an inner side of the earbud in FIG. 1.
Figure 1:
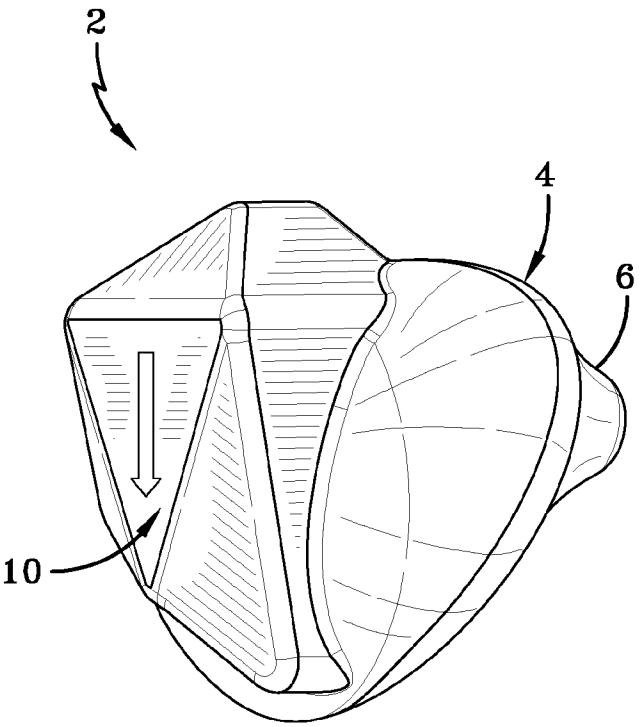
FIG. 1 is a front perspective view of an outer side of an exemplary earbud according to the invention.

Referring initially to FIG. 1 and FIG. 2, an exemplary right-side earbud 2 is shown. In general, the earbud 2 has a generally flattened ovoid-shaped body 4, for example, similar to the shape of a flattened-egg, or the like. The generally flattened ovoid-shaped body 4 has a protrusion 6 extending from an inner side of the body 4, and the protrusion 6 includes an audio port 8 for transmitting audible sound to the user's ear. The generally ovoid-shaped body 4 also includes an outward protuberance 10 extending from an outer side of the body, which may include one or more surfaces for contacting parts of the user's ear to restrict unwanted rotation of the earbud 2 after the earbud has been installed in the ear. As shown in the illustrated embodiment, the outward protuberance 10 is configured as a multi-faceted crown, and the facets of the crown are sloped relative to a central triangular plateau and terminate at respective abutment surfaces which may define a polygonal perimeter around the crown. As will be discussed in further detail below, the respective abutment surfaces may be configured to engage parts of the user's ear to restrict movement of the earbud in an installed position in the ear.

In the illustrated embodiment shown in FIGS. 1-11, the exemplary earbud 2 includes a shell housing having an inner shell portion 14 and an outer shell portion 16. The inner shell portion 14 has an inwardly facing ovate-shaped surface 18 having an ovate-shaped perimeter 20. The inwardly facing ovate-shaped surface 18 has a major axis 21, which extends through the center of the ovate shape between antipodal points furthest away. The major axis 21 extends across a forward end portion 22 and a rearward end portion 24 and divides the ovate-shaped surface 18 between an upper portion 26 and a lower portion 28. The ovate-shaped surface 18 may also have a minor axis (not labeled) extending through the center of the ovate shape perpendicular to the major axis.

The ovate-shaped surface 18 may have a narrower forward end portion 22 having a smaller radius of curvature, and a wider rearward end portion 24 having a larger radius of curvature. The forward end portion 22 may be configured to fit toward the user's ear canal and the rearward end portion 24 may be configured to fit in the concha of the user's ear. When the earbud 2 is in the installed position (shown in FIG. 10, for example), the ovate-shaped surface 18 may be situated in the user's ear such that the forward end portion 22 overlies an opening of the user's ear canal and underlies the user's tragus, and the rearward end portion 24 overlies a lower region of the user's concha and underlies the user's antitragus.

Figure 5:
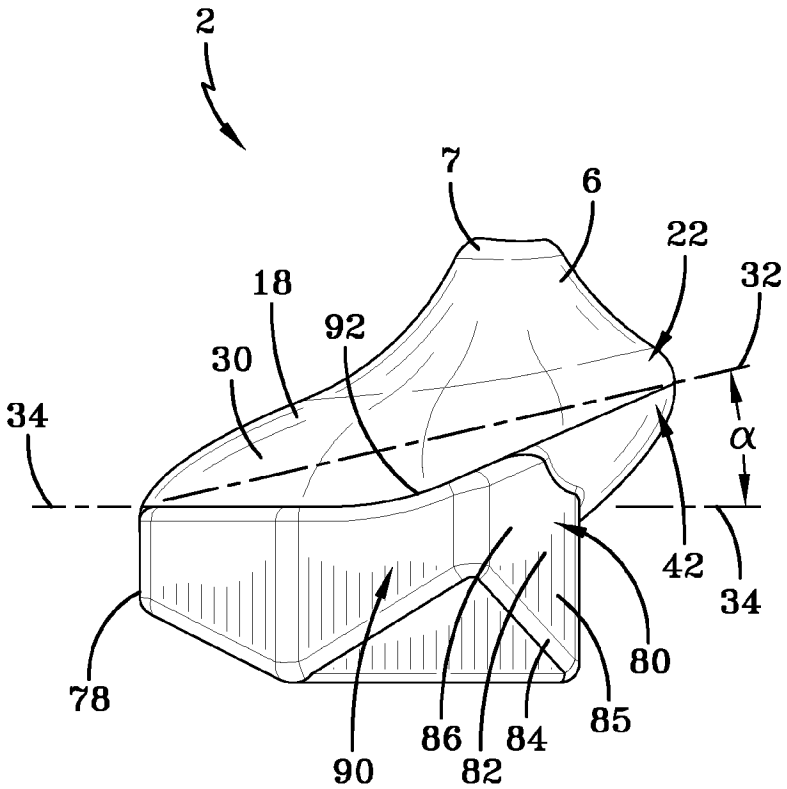
FIG. 5 is a top plan view of the earbud in FIG. 1.

The inwardly facing ovate-shaped surface 18 may have a major portion 30 configured to overlie the concha of the user's ear in the installed position. The major portion 30 may be gradually curved to form a convex dome-shaped surface connecting with the ovate-shaped perimeter 20 and configured to generally contour to a region of the concha of the user's ear. In addition, to further enhance conformance with the user's concha, the perimeter 20 of the ovate-shaped surface 18 may be disposed on a diverging plane 32 that is forwardly inwardly inclined at an angle (a) of between 10 to 20-degrees with respect to a major plane 34 in the installed position (as shown in FIG. 5). The major plane 34 is generally parallel to the side of the user's face (and generally perpendicular to the floor). In some embodiments, it is preferable that the earbud 2 have a small enough footprint that the major portion 30 of the inward surface does not extend upwardly to interfere and/or overlap with the user's crus of helix.

The inwardly facing ovate-shape surface 18 also includes the audio protrusion 6 disposed forwardly of the major portion 30 with respect to the major axis 21. The audio protrusion 6 includes an audio port 8 for transmitting audible sound therethrough. In the illustrated embodiment, the audio protrusion 6 has a frusto-conical outer surface having an apex 7 configured to extend toward the user's ear canal. The apex 7 may have a diameter that is smaller than the diameter of the user's ear canal and preferably does not sealingly engage the ear canal so as to further improve comfort to the user.

The location of the apex 7 and/or audio port 8 with respect to the inwardly facing ovate-shaped surface 18 may also improve comfort and fitment of the earbud 2. For example, as shown in the partial cross-sectional top view of FIG. 11, the audio protrusion 6 may have an axis that is perpendicular to the major plane 34, and preferably the apex 7 does not extend deeply into the user's ear canal. In addition, the apex 7 may be rearwardly spaced from the forward end of the ovate-shaped perimeter 20 so as to limit contact with the entrance to the ear canal. For example, as shown in FIG. 12, the apex 7 (or top of the audio protrusion 6) may be disposed on the major axis 21 of the ovate-shaped surface 18 proximal a forward focal point F1 of an ellipse E1 superimposedly inscribed within the ovate-shaped perimeter 20, where the major axis of the ellipse E1 is aligned with the major axis 21 of the ovate-shaped surface 18. As shown in FIG. 12, the superimposedly inscribed ellipse E1 has an eccentricity of about 0.5. Where the eccentricity of the ellipse E1 is between 0.4 and 0.7, the apex 7 (or top of the audio protrusion 6) may be disposed on the major axis 21 between the center of the superimposedly inscribed ellipse E1 and the focal point F1.

Figure 11:
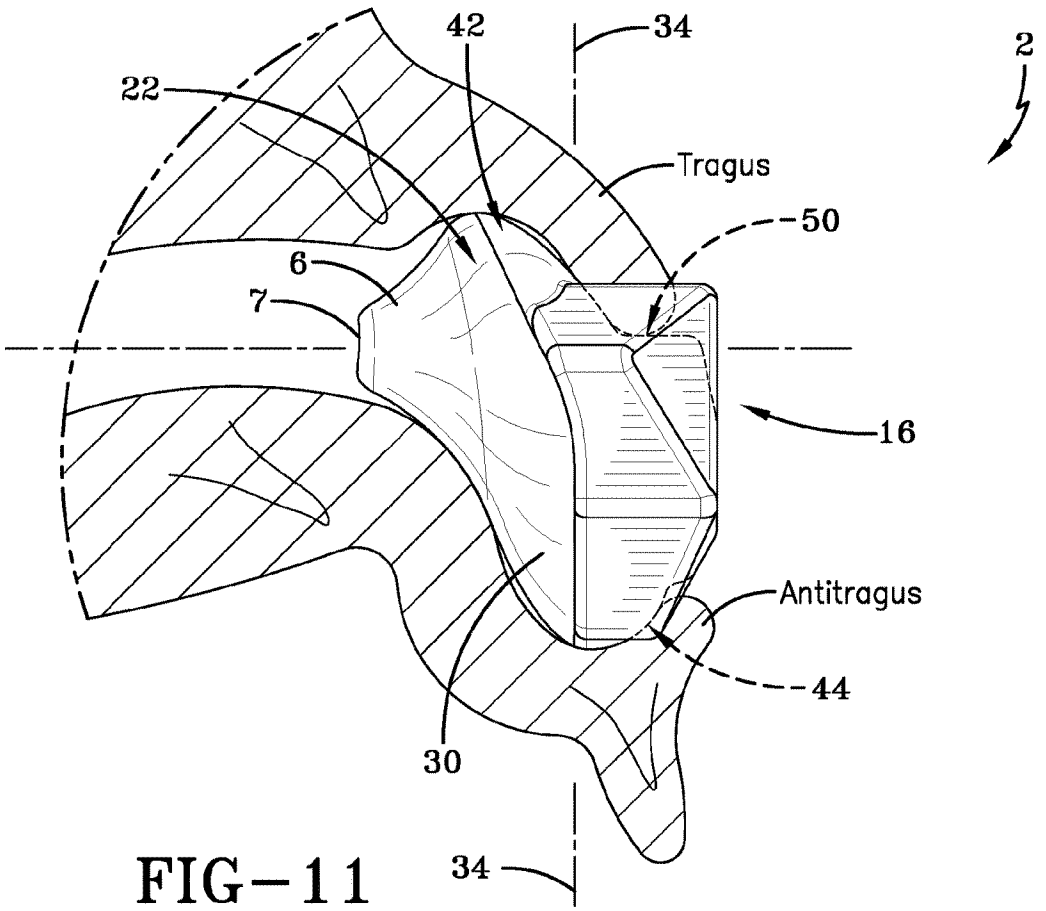
FIG. 11 is a schematic partial cross-sectional top view showing a schematic cross-section of the user's ear taken about the line 11-11 in FIG. 10, and a top view of earbud in FIG. 1 in the installed position in the user's ear.
Figure 12:
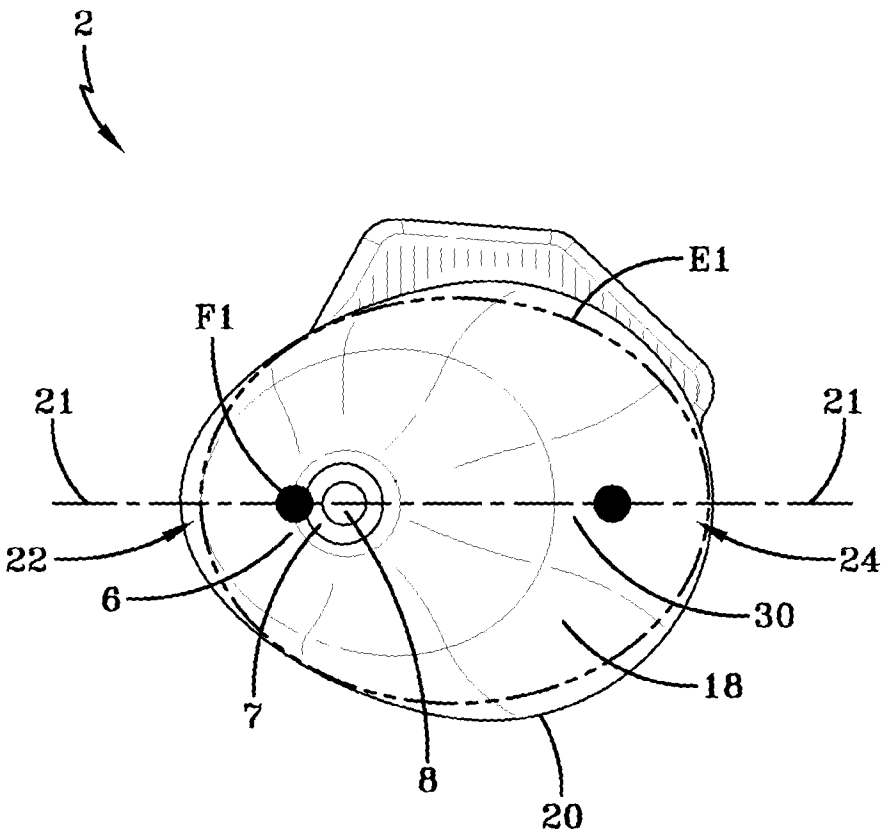
FIG. 12 is a schematic illustration of an ellipse superimposedly inscribed within an ovate-shaped perimeter of an inwardly facing surface of the earbud in FIG. 1.

Still referring to FIGS. 1-11, the outer shell portion 16 has an outwardly facing surface 40 opposite the inwardly facing ovate-shaped surface 18, and the outwardly facing surface 40 connects with the inwardly facing surface 18 at portions around the ovate-shaped perimeter 20. The outwardly facing surface 40 includes an outwardly facing forward end surface 42 corresponding with the forward end portion 22 of the inwardly facing ovate-shaped surface 18. As shown in the illustrated embodiment, the outwardly facing forward end surface 42 may gradually curve outwardly to form a convex dome-shaped surface connecting with the forward end portion perimeter. In this manner, the inner forward end portion 22 and the outer forward end portion 42 may together define a nose of the generally flattened ovoid-shaped body. As shown in FIGS. 10 and 11, the outwardly facing forward end surface 42 may be configured to underlie the tragus of the user's ear and may corn pressably engage the inner part of the user's tragus when the earbud is in the installed position. Such a configuration may enable improved anchoring of the earbud 2 in the user's ear and may help to prevent the earbud 2 from falling out.

The outwardly facing surface 40 also includes an outwardly facing rearward end surface 44 corresponding with the rearward end portion 24 of the inwardly facing ovate-shaped surface 18. As shown in the illustrated embodiment, the outwardly facing rearward end surface 44 may also gradually curve outwardly to form a convex dome-shaped surface connecting with the rearward end portion perimeter. As shown in FIGS. 10 and 11, the outwardly facing rearward end surface 44 may be configured to underlie the antitragus of the user's ear (e.g., overlying the lower concha region) and may compressably engage the inner part of the user's antitragus when the earbud is in the installed position. In addition, having the wider end of the flattened ovoid-shaped body resting in the less-sensitive lower concha portion of the ear may improve comfort and support of the earbud 2, and may also enhance stability of the earbud in the ear.

Figure 7:
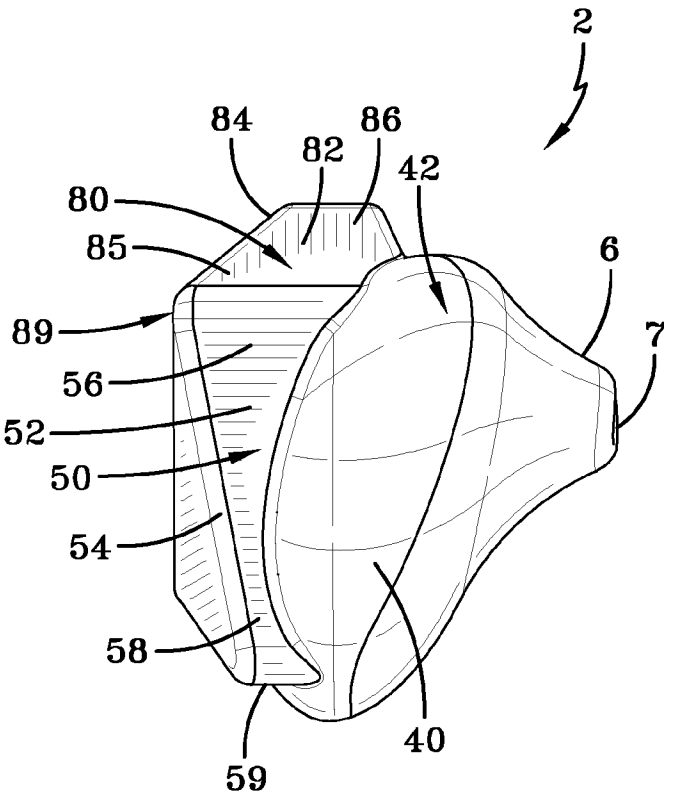
FIG. 7 is a front view of the earbud in FIG. 1.

As discussed above, the outer portion 16 also includes a protuberance 10 having one or more abutment surfaces. For example, as shown in FIGS. 3 and 7, a first outwardly protruding abutment 50 may extend outwardly from the outwardly facing surface 40. The outwardly protruding abutment 50 may be spaced rearwardly from the forward end portion 42 and is configured to face and engage the tragus of the user's ear when the earbud is in an installed position. In the illustrated embodiment, the outwardly protruding abutment 50 is downwardly inclined away from the forward end portion 42 with respect to the major axis 21 (for example, when projected onto a two-dimensional plane of the ovate perimeter), and may be substantially perpendicular to the major plane 34. As shown in FIG. 10, the abutment 50 may be generally perpendicular with the rearwardmost point of the user's tragus in the installed position.

As shown in the illustrated embodiment, the first outwardly protruding abutment 50 may have a relatively flat forwardly facing surface 52 and an outwardly disposed ridge 54. The forwardly facing surface 52 connects with the outwardly facing surface 40 and extends outwardly transverse to the outwardly facing surface 40 to terminate at the outwardly extending ridge 54. In this manner, the outwardly facing forward end surface 42, which engages the inner part of the tragus, cooperates with the outwardly protruding abutment 50, which engages a rearward part of the tragus, so as to restrict unwanted rotation of the earbud 2 in the user's ear and to prevent the earbud from falling out after the earbud has been installed.

In addition, as shown in FIG. 7, an upper portion 56 of the first abutment 50 may protrude further outwardly than a lower portion 58 of the abutment. In other words, the upper portion 56 of the abutment 50 extends further outwardly from the outwardly facing surface 40 than the lower portion 58, such that the ridge 54 slopes upwardly and outwardly. More particularly, the upper portion 56 (or middle portion) may extend outwardly a sufficient distance such that the abutment 50 contacts the user's tragus in the installed position. In addition, the lower portion 58 may recede inwardly from the upper portion 56 by a sufficient distance such that the lower portion 58 is contained within the user's intertragical notch. In this manner, the abutment 50 may terminate at a lower edge 59 or ridge that is configured to engage an inward region of the user's intertragical notch to further improve anchoring of the earbud and restricting rotation in the user's ear.

Figure 8:
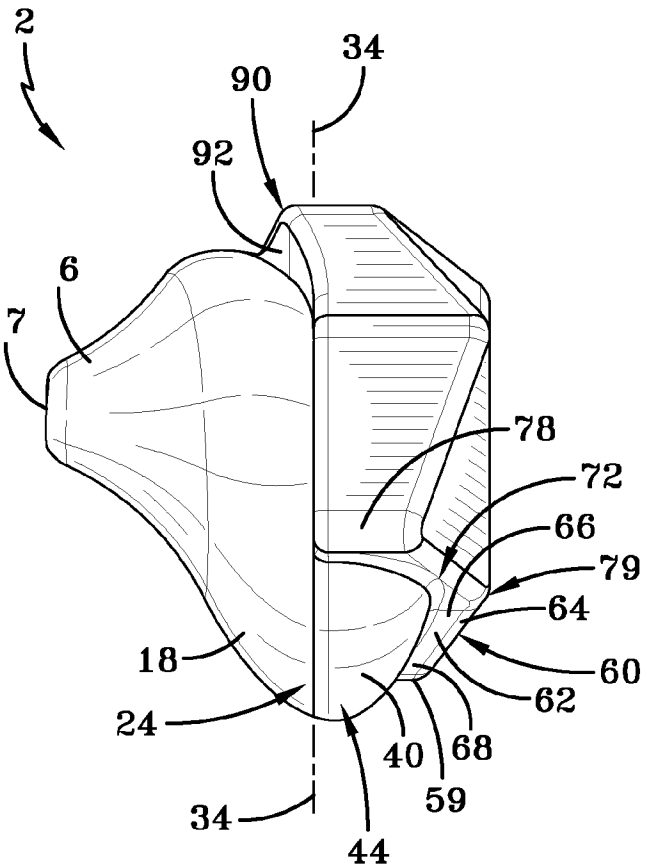
FIG. 8 is a rear view of the earbud in FIG. 1.

The outer portion 16 may also include a second outwardly protruding abutment 60 extending outwardly from the outwardly facing surface 40. For example, as shown in FIGS. 3 and 8, the second outwardly protruding abutment 60 may be spaced forwardly from the rearward end portion 44 and may be configured to face and engage the antitragus of the user's ear when the earbud is in an installed position. In the illustrated embodiment, the second abutment 60 is downwardly inclined away from the rearward end portion 44 with respect to the major axis 21 (for example, when projected onto a two-dimensional plane of the ovate perimeter), and may be substantially perpendicular to the major plane 34.

As shown in the illustrated embodiment, the second abutment 60 may have a relatively flat rearwardly facing surface 62 and an outwardly disposed ridge 64. The rearwardly facing surface 62 connects with the outwardly facing surface 40 and extends outwardly transverse to the outwardly facing surface 40 to terminate at the outwardly extending ridge 64. In this manner, the outwardly facing rearward end surface 44, which engages the inner part of the antitragus, cooperates with the second outwardly protruding abutment 60, which engages a forward part of the antitragus, so as to restrict unwanted rotation of the earbud 2 in the user's ear and to prevent the earbud from falling out after the earbud has been installed.

In addition, as shown in FIG. 8, an upper portion 66 of the second abutment 60 may protrude further outwardly than a lower portion 68 of the abutment 60 such that 64 slopes upwardly and outwardly. More particularly, the upper portion 66 (or middle portion) may extend outwardly a sufficient distance such that the second abutment 60 contacts the user's antitragus in the installed position. In addition, the lower portion 68 may recede inwardly from the upper portion 66 by a sufficient distance such that the lower portion 68 is contained within the user's intertragical notch. In this manner, the second abutment 60 may terminate at the lower edge 59 or ridge that is configured to engage an inward region of the user's intertragical notch to further improve anchoring of the earbud and restricting rotation in the user's ear.

Figure 6:
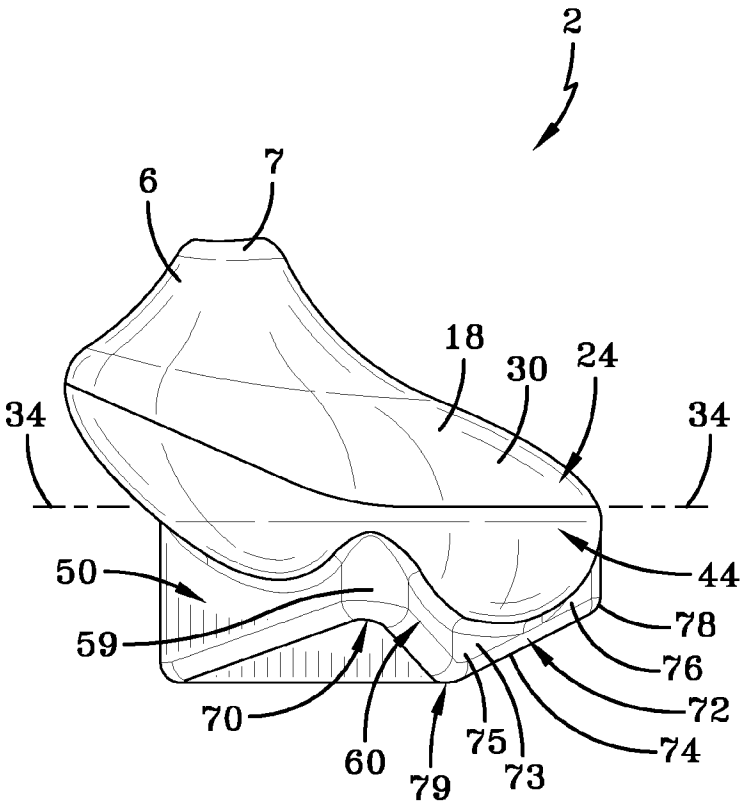
FIG. 6 is a bottom plan view of the earbud in FIG. 1.

As shown in FIG. 3 and FIG. 6, the lower end of the first outwardly protruding abutment 50 connects with the lower end of the second outwardly protruding abutment 60 at the lower edge 59, or lower ridge, to define a convex surface 70 having a vertex at the lower edge 59. In the illustrated embodiment, the convex surface 70 is configured to define an acute angle between the first abutment 50 and the second abutment 60.

In addition, as shown in FIG. 10, the convex surface 70 may be configured to be contained within the intertragical notch of the user's ear in the installed position. More particularly, the convex surface 70 including first abutment surface 50, second abutment surface 60, and lower edge 59 may be configured to engage an inward region of the intertragical notch so as to help anchor the earbud in place. In this manner, the respective outwardly protruding abutments 50, 60 projected onto a two-dimensional plane of the ovate-shaped surface may be completely contained within the ovate-shaped perimeter such that the lower edge 59 or ridge terminates at or above a lower portion of the ovate-shaped perimeter 20, and thus the vertex preferably does not extend beyond or overlap the outer ridge of the intertragical notch of the user's ear.

Referring again to FIGS. 3, 6 and 8, the outer portion 16 may also include a third outwardly protruding abutment 72 extending outwardly from the outwardly facing surface 40. In the illustrated embodiment, the third outwardly protruding abutment 72 is upwardly inclined toward the rearward end portion 44 with respect to the major axis 21 (for example, when projected onto a two-dimensional plane of the ovate perimeter), and may be substantially perpendicular to the major plane 34.

As shown in the illustrated embodiment, the third abutment 72 may have a relatively flat downwardly facing surface 73 and an outwardly disposed ridge 74. The downwardly facing surface 73 connects with the outwardly facing surface 40 and extends outwardly transverse to the outwardly facing surface 40 to terminate at the outwardly extending ridge 74. In addition, as shown in FIG. 6, a forwardly disposed portion 75 of the third abutment 72 may protrude further outwardly than a rearwardly disposed portion 76, such that the third abutment recedes inwardly from the forwardly disposed portion 75 toward the rearward portion 76 by a sufficient distance to allow the third abutment 72 to underlie the user's antihelix in the installed position.

More particularly, as shown in FIG. 3, the third abutment 72 may extend rearwardly to terminate at a rearward edge 78 or ridge formed in a convex shape that is transverse to the major plane 34, and which may extend outside of the ovate-shaped perimeter 20 (when projected against a two-dimensional plane of the ovate perimeter, for example). In this manner, the rearward edge 78 or ridge, may be configured to engage a region of the ear underlying the antihelix to provide a rear locking feature of the earbud to further enhance anchoring and restricting unwanted rotation.

In addition, as shown in the illustrated embodiment in FIG. 3, the forward end portion 75 of the third abutment 72 may connect with the upper end 66 of the second abutment 60 at a second vertex to define a concave surface 79 having an obtuse acute angle between the second abutment 60 and the third abutment 72. The concave surface 79 including the abutments 60, 72 may be configured to be disposed about the antitragus of the user's ear in the installed position.

Referring to FIGS. 4, 5 and 7, the outer portion 16 may also include a fourth outwardly protruding abutment 80 extending outwardly from a portion of the outwardly facing surface 40. In the illustrated embodiment, the fourth outwardly protruding abutment 80 is upwardly inclined away from the forward end portion 42 with respect to the major axis 21 (for example, when projected onto a two-dimensional plane of the ovate perimeter), and may be substantially perpendicular to the major plane 34.

As shown in the illustrated embodiment, the fourth abutment 80 may have a relatively flat upwardly facing surface 82 and an outwardly disposed ridge 84. The upwardly facing surface 82 connects at a portion of the outwardly facing surface 40 and extends outwardly transverse to the outwardly facing surface 40 to terminate at the outwardly extending ridge 84. In addition, as shown in FIG. 5, a lower disposed portion 85 of the third abutment 80 may protrude further outwardly than an upper disposed portion 86, and the upper disposed portion 86 may project upwardly outside of the ovate-shaped perimeter 20.

More particularly, as shown in FIG. 3, the fourth abutment 80 may extend forwardly to terminate at a forward edge or ridge to connect with the upper end 56 of the first abutment 50 to form a convex surface 89 having an obtuse angle between the first abutment 50 and the fourth abutment 80. The convex surface 89 may be configured to fit within the anterior notch of the user's ear in the installed position.

Referring to FIGS. 3-5 and 8, the earbud 2 may further include an upper protrusion 90 having one or more upper ridges extending upwardly with respect to the upper portion 26 of the ovate-shaped surface 18 and being disposed outside of the ovate-shaped perimeter 20. The upper protrusion 90 may have a relief surface 92, such as an outwardly curved surface, that is configured to cooperate with the crus of helix of the user's ear in the installed position. For example, the upper protrusion 90 may be outwardly spaced from the inwardly facing ovate-shaped surface 18 to allow the crus of helix to run along the relief surface 92 atop the top portion 26 of the ovate surface. The upper protrusion 90 may cooperate with the forward end surface 42 and the fourth abutment 80 to provide further stability and restricting unwanted rotation of the earbud 2 after it has been installed.

As shown in the illustrated embodiment, the respective outwardly protruding abutments (e.g., 50, 60, 72, 80), the respective faces (e.g., 52, 62, 73, 82), and/or the respective outwardly disposed ridges (e.g., 54, 64, 74, 84) may extend continuously in a substantially straight path. Since these respective surfaces may engage certain sensitive parts of the user's ear, such straight surfaces may reduce contact area with those sensitive regions while still providing adequate anchoring properties to restrict unwanted rotation of the earbud in the user's ear. It is understood, however, that such abutments, faces, and/or ridges may also be discontinuous or segmented, or may be curved or have compound surfaces. In addition, the illustrated embodiment shows the respective edges (e.g., 59, 78) or corresponding transverse ridges, the respective convex surfaces (e.g., 70, 89), and/or the respective concave surface (e.g., 79) as having continuous and relatively sharp corners or relatively small radii of curvature. Since these respective surfaces may engage certain sensitive parts of the user's ear, such relatively sharp corners may reduce contact area with those sensitive regions while still providing adequate anchoring properties to restrict unwanted rotation of the earbud in the user's ear. It is understood, however, that such edges, ridges, vertices, convex and/or concave surfaces may also be discontinuous or segmented, or may be more curved or have a larger radius of curvature.

Figure 13C:
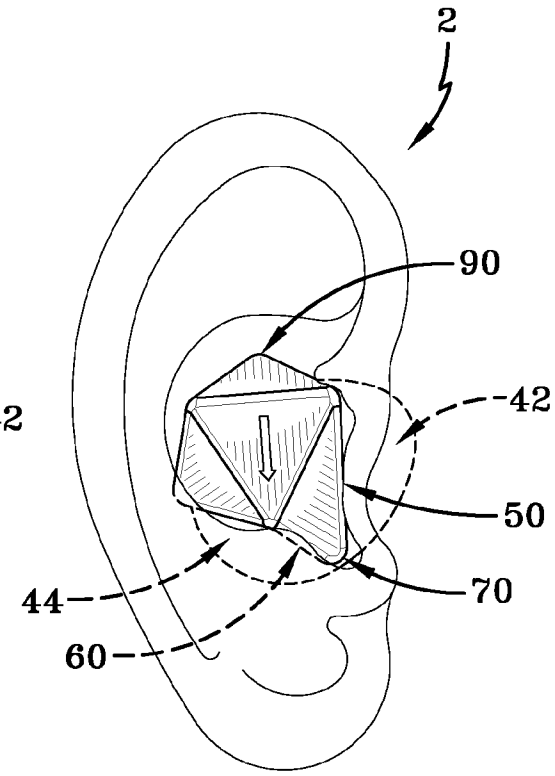
FIGS. 13A-13C schematically illustrate an exemplary method of inserting the earbud in FIG. 1 in the user's ear.
Figure 13B:
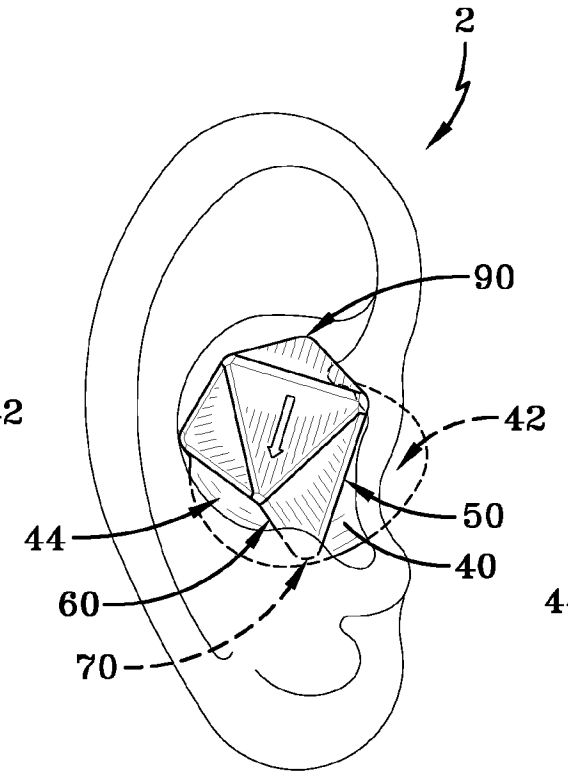
Figure 13A:
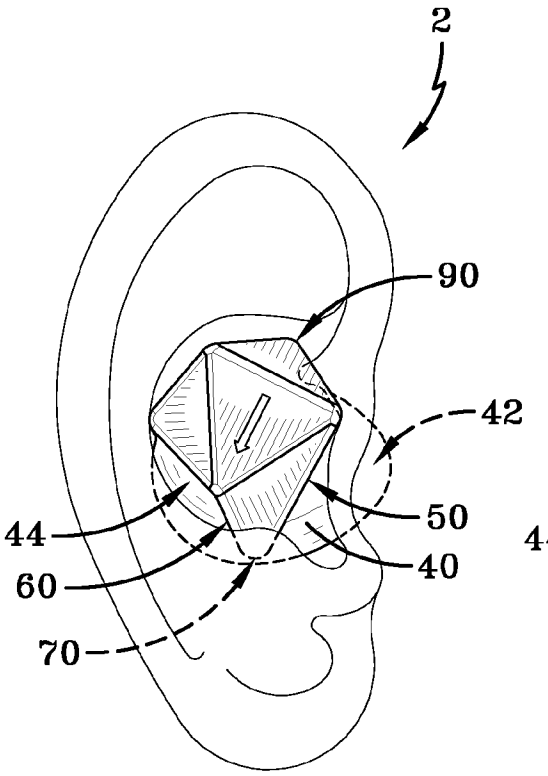

Turning now to FIGS. 13A-13C, an exemplary method of inserting the exemplary earbud 2 is shown. First, the user grips the earbud 2, preferably with only one hand, along one or more outwardly protruding abutments (e.g., 50, 60, 72, 80) and/or ridges (e.g., 54, 64, 74, 84). Then the user inserts the earbud 2 into the user's outer ear by placing the forward end portion 22, 42 under the user's tragus and the rearward end portion 24 in the middle of the user's concha, as exemplified in FIG. 13A. Then the user rotates the earbud in the user's ear (counterclockwise as exemplified in FIG. 13B) toward a position in which the forward end portion 22, 42 is pointing upward and the rearward end portion 24 overlies a lower region of the user's concha.

The user continues to rotate the earbud (counterclockwise as exemplified in FIG. 13B) to the installed position (exemplified in FIG. 13C), wherein the first abutment surface 50 engages the user's tragus and the forward end portion 22 of the ovate-shaped surface points upwardly with the audio protrusion 6 toward the user's ear canal, and the rearward end portion 24 of the ovate-shaped surface overlies the user's lower concha, preferably with the major portion 30 being disposed lower than the crus of helix. In addition, the convex surface 70 being defined by the first abutment surface 50 and the second abutment surface 60 may be positioned within the user's intertragical notch such that the lower edge 59 engages an inward region of the intertragical notch to enable anchoring of the earbud 2 and restricting unassisted rearward rotation of the earbud. In addition, the convex surface 79 may be disposed about the antitragus and the second abutment 60 may engage the antitragus to further restrict movement. The rearward edge 78 or ridge of the third abutment 72 may engage a region underlying the user's antihelix to provide a rearward anti-rotation lock. A forward edge 89 or ridge may be positioned within the anterior notch and the crus of helix may run along the inside of the upward protrusion 90, again for enhancing stability of the device.

Such a method of insertion and configuration for fitment of the exemplary earbud enables the earbud to be easily placed into the ear without excessively forcing the audio protrusion deeply into the ear canal. The method of insertion and configuration for fitment of the exemplary earbud also enables the earbud to be comfortably anchored into place to provide an anti-rotation lock which increases stability and prevents the earbud from falling out. The configuration may also distribute weight or force of the exemplary earbud into less sensitive regions such as the lower concha, while preferably minimizing contact area with other more sensitive regions such as the tragus, the antitragus and the ear canal.

Figure 14:
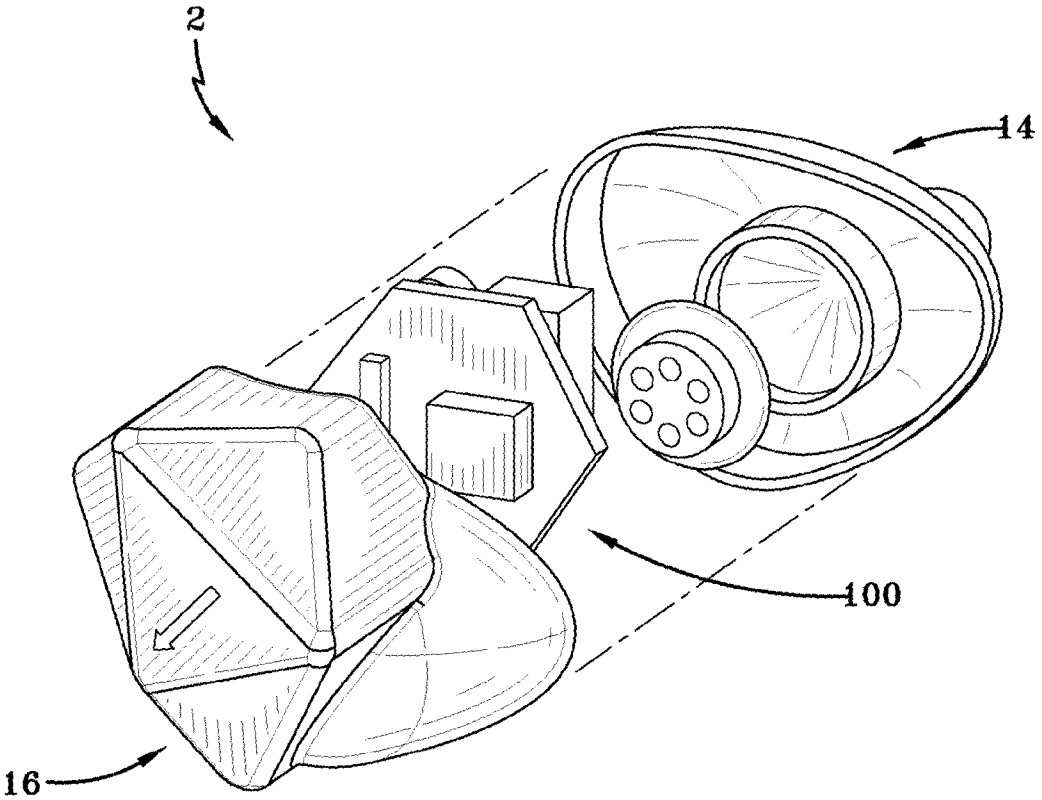
FIG. 14 is an exploded perspective view of the earbud in FIG. 1 showing electronic components therein.

Turning to FIG. 14, an exploded view of the exemplary earbud 2 is shown having electronic components 100 contained therein. The electronic components 100 may include a driver (speaker), PCB and integrated circuitry, a battery, and a wireless chipset, such as Bluetooth, to wirelessly receive or transmit signals with a media device or the other earbud. The shell housing may include visual indicators, such as LEDs, or may have input devices, such as buttons, to enhance operability of the device. Preferably the shell housing completely contains all of the electronic components required for transmitting audible sound, and preferably the earbud is devoid of external electrical wiring.

The shell housing or casing may be made of a rigid plastic material, such as polyethylene, polypropylene, PVC or the like, however, the exemplary earbud may also having elastic coverings, such as rubber bumpers on portions of the earbud, which may improve comfort. The shell housing may be pre-formed in pieces, such as two halves, for enabling electronic components to be installed inside of the housing and then being assembled together to form the shell housing, as exemplified in FIG. 14.

The shell housing may also include a waterproof or water-resistant seal that enables the exemplary earbud to be used in locations where traditional earbuds would not be used, such as swimming pools for aquatic sports, rainy conditions, and the like. For example, in some exemplary embodiments, the earbud may be covered or encased in a waterproof or water-resistant thin film or barrier layer. In addition, in some exemplary embodiments, the audio port may include a thin film or barrier layer configured to prevent liquid from entering the interior of the earbud, while enabling audible sound to pass through the film or barrier layer.

Figure 15:
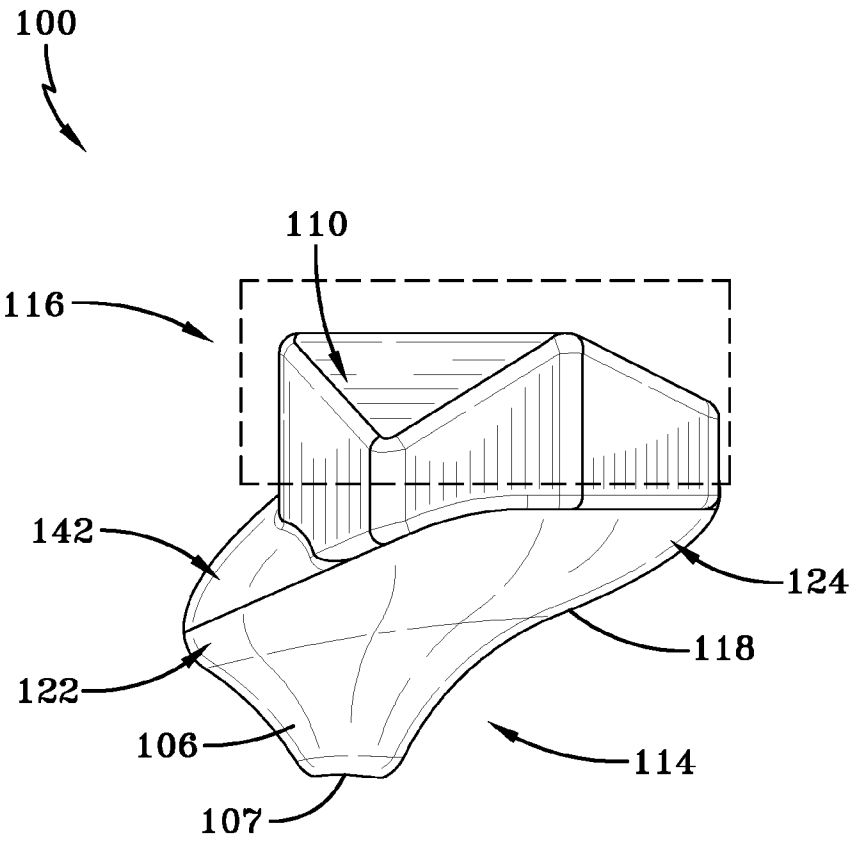
FIG. 15 is a top plan view of another exemplary earbud according to the invention.

Turning now to FIG. 15, another exemplary embodiment of a wireless earbud 100 is shown. The earbud 100 is substantially the same as the above-referenced earbud 2, except that the outward protuberance 110 is shown as being outwardly expanded to accommodate additional or larger electronic components, for example. Consequently, the same reference numerals but indexed by 100 are used to denote structures corresponding to similar structures of the earbud 2. In addition, the foregoing description of the earbud 2 is equally applicable to the earbud 100.

As shown and described herein, an exemplary wireless earbud includes an inner surface adapted to fit in the concha of a user's ear, and one or more outer protrusions configured to engage other parts of the user's ear, which restricts unwanted movement and prevents the earbud from falling out of the ear, and improves the comfort and fitment of the earbud in the user's ear.

According to an aspect of the invention, a wireless earbud for engaging and acoustically communicating with a user's ear includes a shell housing having an inner shell portion and an outer shell portion opposite the inner shell portion. The inner shell portion has an inwardly facing ovate-shaped surface having an ovate-shaped perimeter, the ovate-shaped surface having a narrower forward end portion configured to fit toward the user's ear canal, and a wider rearward end portion opposite the forward end portion, the rearward end portion being configured to fit in the concha of the user's ear.

Embodiments of the invention may include one or more of the following additional features separately or in combination.

For example, the outer shell portion may have an outwardly facing surface opposite the inwardly facing surface, the outwardly facing surface connecting with the inwardly facing surface at portions around the ovate-shaped perimeter, and an outwardly protruding abutment extending outwardly from the outwardly facing surface. The outwardly protruding abutment may be spaced rearwardly from the forward end portion, wherein the outwardly protruding abutment is configured to face and engage the tragus of the user's ear when the earbud is in an installed position in the user's ear.

The inwardly facing ovate-shaped surface may have a major axis that extends across the forward end portion and the rearward end portion between an upper portion and a lower portion of the ovate-shaped surface, and the outwardly protruding abutment may be downwardly inclined away from the forward end portion with respect to the major axis.

In the installed position, the inwardly facing ovate-shaped surface may be situated in the user's ear such that the rearward end portion overlies a lower region of the user's concha and underlies the user's antitragus, and the forward end portion overlies an opening of the user's ear canal and underlies the user's tragus. In the installed position, the outwardly protruding abutment may be perpendicular with the user's tragus.

An upper or middle portion of the outwardly protruding abutment may protrude further outwardly than a lower portion of the abutment.

The upper or middle portion of the outwardly protruding abutment may extend outwardly a sufficient distance such that the abutment contacts the user's tragus in the installed position.

The lower portion of the abutment may recede inwardly from the upper portion of the abutment by a sufficient distance such that the lower portion of the abutment is contained within the user's intertragical notch in the installed position.

The outwardly facing surface includes an outwardly facing forward end surface corresponding with the forward end portion of the inwardly facing ovate-shaped surface. The outwardly facing forward end surface may gradually curve outwardly to form a convex dome-shaped surface connecting with the forward end portion perimeter.

The outwardly facing forward end surface may be configured to underlie and engage the inner part of the tragus of the user's ear in the installed position and to cooperate with the outwardly protruding abutment to restrict rotation of the earbud in the user's ear and to prevent the earbud from falling out of the user's ear after the earbud is in the installed position.

The ovate-shaped perimeter of the inwardly facing ovate-shaped surface may be substantially disposed on a diverging plane that is forwardly inwardly inclined with respect to a major plane, where the major plane is generally parallel to the side of the user's face in the installed position.

The diverging plane may be inclined at an angle between 10 to 30-degrees with respect to the major plane, preferably about 15-degrees.

The outwardly protruding abutment may be substantially perpendicular to the major plane.

The inwardly facing ovate-shaped surface may have a major portion configured to overlie the concha of the user's ear in the installed position.

The major portion may be gradually curved to form a convex dome-shaped surface connecting with the ovate-shaped perimeter and configured to generally contour to a region of the concha.

The major portion may be disposed in a lower region of the concha, and preferably the inwardly facing surface does not extend upwardly beyond the crus of helix of the user's ear.

An audio protrusion may be disposed on the inwardly facing ovate-shaped surface, the audio protrusion being disposed forwardly of the major portion with respect to the major axis.

The outer shell portion may further include a second outwardly protruding abutment extending from the outwardly facing surface.

The second outwardly protruding abutment may be spaced forwardly from the rearward end portion, and the second outwardly protruding abutment may be configured to face and engage the antitragus of the user's ear when the earbud is in an installed position in the user's ear.

The second outwardly protruding abutment may be downwardly inclined with respect to the major axis.

An upper or middle portion of the second outwardly protruding abutment may extend outwardly from the outwardly facing surface a sufficient distance such that the second abutment contacts the user's antitragus in the installed position.

A lower portion of the second abutment may recede inwardly from the upper portion of the second abutment by a sufficient distance such that the lower portion of the second abutment is contained within the user's intertragical notch in the installed position.

A lower end of the second outwardly protruding abutment may connect with a lower end of the first outwardly protruding abutment at a lower edge to define a convex surface having a vertex at the lower edge.

The convex surface may be contained within the intertragical notch of the user's ear in the installed position and may be configured to help anchor the earbud into an inward region of the intertragical notch of the user's ear.

In some embodiments, the first abutment, the second abutment, and/or the convex surface do not extend downwardly beyond the lower outer ridge of the intertragical notch of the user's ear.

The outwardly facing surface may include an outwardly facing rearward end surface corresponding with the rearward end portion of the inwardly facing ovate-shaped surface.

The outwardly facing rearward end surface may gradually curve outwardly to form a convex dome-shaped surface connecting with the rearward end portion perimeter.

The outwardly facing rearward end surface may be configured to underlie and engage the inner part of the antitragus of the user's ear in the installed position and to cooperate with the second outwardly protruding abutment to restrict rotation of the earbud in the user's ear and to prevent the earbud from falling out of the user's ear after the earbud is in the installed position.

The outer shell portion may further include a third outwardly protruding abutment extending from the outwardly facing surface.

The third outwardly protruding abutment may terminate at an outwardly extending third ridge and may be configured to engage and/or underlie the antihelix of the user's ear when the earbud is in an installed position in the user's ear.

The third outwardly protruding abutment may be upwardly inclined toward the rearward end portion with respect to the major axis. A forwardly disposed portion of the third abutment may protrude further outwardly than a rearwardly disposed portion of the third abutment.

The rearwardly disposed portion of the third abutment may recede inwardly from the forwardly disposed portion of the third abutment by a sufficient distance such that the rearwardly disposed portion of the third abutment underlies the user's antihelix in the installed position.

The rearward end of the third outwardly protruding abutment may terminate at a rearward ridge. The rearward ridge may extend outside of the ovate-shaped perimeter and may be configured to engage a region of the ear underlying the antihelix to enable anchoring and restricting rotation of the earbud in the user's ear in the installed position.

A forwardly disposed end of the third abutment may connect with the upper end of the second abutment to define a concave surface. The concave surface may be configured to be disposed about the antitragus of the user's ear in the installed position.

The outer shell portion may further include a fourth outwardly protruding abutment extending from the outwardly facing surface.

The fourth outwardly protruding abutment may be upwardly inclined away from the forward end portion with respect to the major axis. A forwardly disposed end of the fourth abutment may connect with the upper end of the first abutment at a forward ridge, and the forward ridge may be configured to fit within the anterior notch of the user's ear.

The exemplary earbud may include one or more upper ridges extending upwardly with respect to the upper portion of the ovate-shaped surface. The one or more upper ridges may form a curved relief configured to cooperate with the crus of helix of the user's ear in the installed position.

An audio protrusion may be disposed on the inwardly facing ovate-shaped surface having a frusto-conical outer surface. The apex of the frusto-conical surface may have an audio port is configured to extend toward the user's ear canal.

In some embodiments, the exemplary earbud does not use elastic grommets that compress deeply into the user's ear canal.

The apex of the audio protrusion may be disposed proximal a focal point of an ellipse superimposedly inscribed within the ovate-shaped perimeter, the superimposedly inscribed ellipse having a major axis aligned with the major axis of the ovate-shaped surface, the focal point being closer to the forward end portion of the ovate-shaped surface.

The apex of the audio protrusion may have a diameter that is smaller than the diameter of the user's ear canal, and the apex of the audio protrusion may be devoid of a rubberized grommet and does not sealingly engage the ear canal.

Two or more of the outwardly protruding abutments may extend outwardly from the outwardly facing surface and terminate at respective outwardly extending ridges. The respective ridges may be connected by a multi-faceted surface, the respective facets sloping upwardly from the respective ridges toward a central plateau.

One or more of the outwardly protruding abutments may extend continuously in a straight path.

The shell housing may completely contain all of the electronic components required for transmitting audible sound, and wherein the earbud is devoid of external electrical wiring and communicates wirelessly to receive or transmit signals.

The shell housing may be a rigid casing.

Preferably, the earbud is devoid of spring-like arms or other external structures attached to the shell housing.

According to another aspect of the invention, a wireless earbud for engaging and acoustically communicating with a user's ear includes a housing having an inner portion and an outer portion opposite the inner shell portion. The inner portion has an inwardly facing ovate-shaped surface having an ovate-shaped perimeter, the ovate-shaped surface being configured to fit in the concha of the user's ear. The outer portion has an outwardly facing surface opposite the inwardly facing surface. The outwardly facing surface has a first outwardly protruding abutment and second outwardly protruding abutment, the respective abutments extending from the outwardly facing surface, the first abutment connecting with the second abutment to define a convex abutment surface that is configured to fit within the user's intertragical notch when the earbud is in an installed position.

Embodiments of the invention may include one or more of the following additional features separately or in combination.

The first abutment surface and the second abutment surface may connect at a lower ridge, the lower ridge defining a vertex of the convex abutment surface.

The lower ridge may be configured to engage a region inward of the user's intertragical notch to anchor the earbud and restrict rotation of the earbud in the installed position.

The convex surface may not extend outside of the user's intertragical notch.

The first abutment surface may extend upwardly from the vertex toward the forward end portion in a continuous and straight path to engage the user's tragus in the installed position, and the second abutment may extend upwardly from the vertex toward the rearward end portion in a continuous and straight path to engage the user's antitragus.

The outer portion may further include a third outwardly protruding abutment extending from the outwardly facing surface.

The third outwardly protruding abutment may have a forwardly disposed end connecting with the upper end of the second abutment to define a concave surface, the concave surface being disposed about the antitragus of the user's ear in the installed position.

The third abutment may terminate at a rearwardly disposed end that is opposite the forwardly disposed end, the rearwardly disposed end of the third abutment being configured to underlie the antihelix of the user's ear when the earbud is in an installed position.

The ovate-shaped surface may have a narrower forward end portion configured to fit toward the user's ear canal, and a wider rearward end portion opposite the forward end portion, the rearward end portion being configured to fit in the concha of the user's ear.

According to another aspect of the invention, a wireless earbud for engaging and acoustically communicating with a user's ear includes a housing having an inner portion and an outer portion opposite the inner portion. The inner portion has an inwardly facing ovate-shaped surface having an ovate-shaped perimeter, the ovate-shaped surface having a narrower forward end portion configured to fit toward the user's ear canal, and a wider rearward end portion opposite the forward end portion, the rearward end portion being configured to fit in the concha of the user's ear.

The inwardly facing ovate-shaped surface has an audio cone extending inwardly toward the ear canal, the audio cone having an audio port for transmitting audible sound therethrough. An apex of the audio cone is disposed proximal a focal point of an ellipse superimposedly inscribed within the ovate-shaped perimeter, the superimposedly inscribed ellipse having a major axis aligned with the major axis of the ovate-shaped surface, the apex of the audio cone being disposed proximal the focal point of the superimposedly inscribed ellipse that is closer to the forward end portion of the ovate-shaped surface.

Embodiments of the invention may include one or more of the following additional features separately or in combination.

The superimposedly inscribed ellipse may have an eccentricity of between 0.4 and 0.7, preferably about 0.5, and the apex of the audio cone may be disposed on the major axis between the center of the superimposedly inscribed ellipse and the focal point of the superimposedly inscribed ellipse.

The audio cone may have an axis that is perpendicular to a major axis which is generally parallel to the side of the user's face when the earbud is in the installed position.

The earbud may further include a plurality of ridges extending outwardly from the outwardly facing surface to define an outward protuberance having a polygonal perimeter.

The earbud may further include a multi-faceted crown protruding outwardly from the outwardly facing surface, wherein the facets of the crown are sloped relative to a central region of the crown and terminate at respective abutment surfaces, the respective abutment surfaces being configured to restrict movement of the earbud in the installed position.

According to another aspect of the invention, a wireless earbud for engaging and acoustically communicating with a user's ear includes a generally flattened ovoid-shaped body, a cone-shaped protrusion extending outwardly from one side of the generally flattened ovoid-shaped body, and a multi-faceted crown protruding outwardly from the opposite side of the generally flattened ovoid-shaped body.

Embodiments of the invention may include one or more of the following additional features separately or in combination.

For example, the generally flattened ovoid-shaped body may have a narrower forward end portion configured to fit toward the user's ear canal, and a wider rearward end portion opposite the forward end portion, the rearward end portion being configured to fit in the concha of the user's ear.

The generally flattened ovoid-shaped body has a principal axis extending across the forward end portion and the rearward end portion, and the cone-shaped protrusion may be offset from the multi-faceted crown in a forward direction along the principal axis.

The cone-shaped protrusion includes an audio conduit and an audio port for transmitting audible sound.

The multi-faceted crown may have a flat plateau, and the respective facets may slope from the plateau toward the generally flattened ovoid-shaped body and terminate at respective abutment surfaces, the respective abutment surfaces being configured to restrict movement of the earbud in the installed position.

According to yet another aspect of the invention, a method of inserting an earbud into a user's ear includes the steps: (i) gripping the earbud according to any of the preceding claims along one or more outwardly protruding abutments; (ii) inserting the earbud into the user's outer ear by placing the forward end portion of the ovate-shaped surface under the user's tragus and the rearward end portion of the ovate-shaped surface in the user's concha; (iii) rotating the earbud in the user's ear toward a position in which the forward end portion is pointing upward and the rearward end portion overlies a lower region of the user's concha; (iv) continuing to rotate the earbud to the installed position, whereby the first-mentioned abutment surface engages the user's tragus and the forward end portion of the ovate-shaped surface points upwardly toward the user's ear canal and the rearward end portion of the ovate-shaped surface overlies the user's concha; and (v) optionally, positioning a convex surface defined by the first abutment surface and a second abutment surface within the user's intertragical notch, the convex surface having a lower edge that engages an inward region of the intertragical notch to enable anchoring of the earbud and restricting unassisted rearward rotation of the earbud.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A wireless earbud for engaging and acoustically communicating with a user's ear, the earbud comprising:

a housing having an inner portion and an outer portion opposite the inner portion;

the inner portion having an inwardly facing ovate-shaped surface having an ovate-shaped perimeter, the ovate-shaped surface being configured to fit in the concha of the user's ear; and the outer portion having an outwardly facing surface opposite the inwardly facing surface, wherein the outer portion has a first outwardly protruding abutment and a second outwardly protruding abutment, the respective first and second abutments extending from the outwardly facing surface, the first abutment connecting with the second abutment to define a convex abutment surface that is configured to fit within the user's intertragical notch when the earbud is in an installed position.

2. The wireless earbud according to claim 1, wherein the first abutment and the second abutment connect at a lower ridge, the lower ridge defining a vertex of the convex abutment surface, and wherein the lower ridge is configured to engage an inward region of the user's intertragical notch to anchor the earbud and restrict rotation of the earbud in the installed position.

3. The wireless earbud according to claim 1, wherein the convex abutment surface does not extend outside of the user's intertragical notch.

4. The wireless earbud according to claim 2, wherein the first abutment extends upwardly from the vertex in a continuous and straight path to engage the user's tragus in the installed position, and wherein the second abutment extends upwardly from the vertex in a continuous and straight path to engage the user's antitragus.

5. The wireless earbud according to claim 1, wherein the outer portion further includes a third outwardly protruding abutment extending from the outwardly facing surface, the third outwardly protruding abutment having a forwardly disposed end connecting with an upper end of the second abutment to define a concave surface, the concave surface being disposed about the antitragus of the user's ear in the installed position, and wherein the third abutment terminates at a rearwardly disposed end that is opposite the forwardly disposed end, the rearwardly disposed end of the third abutment being configured to underlie the antihelix of the user's ear when the earbud is in an installed position.

6. The wireless earbud according to claim 1, wherein the ovate-shaped surface has a narrower forward end portion configured to fit toward the user's ear canal, and a wider rearward end portion opposite the forward end portion, the rearward end portion being configured to fit in the concha of the user's ear.

7. The wireless earbud according to claim 1, wherein the convex abutment surface is V-shaped, and has a vertex configured to be disposed within the intertragical notch of the user's ear when the earbud is in the installed position.

8. The wireless earbud according to claim 7, wherein the vertex of the V-shaped convex abutment surface is rounded.

9. The wireless earbud according to claim 1, wherein an upper and/or middle portion of the first outwardly protruding abutment protrudes further outwardly than a lower portion of the first abutment, wherein the upper and/or middle portion of the first outwardly protruding abutment extends outwardly from the outwardly facing surface such that the first abutment contacts the user's tragus when in the installed position, and wherein the lower portion of the first abutment recedes inwardly relative to the upper and/or middle portion of the first abutment such that the lower portion of the first abutment is contained within an inward region of the user's intertragical notch when the earbud is in the installed position.

10. The wireless earbud according to claim 9, wherein an upper and/or middle portion of the second outwardly protruding abutment protrudes further outwardly from the outwardly facing surface than a lower portion of the second abutment.

11. The wireless earbud according to claim 1, wherein the outwardly facing surface includes an outwardly facing forward end surface, and wherein the outwardly facing forward end surface gradually curves outwardly to form a convex dome-shaped surface that connects with the ovate-shaped perimeter of the inwardly facing ovate-shaped surface, the outwardly facing forward end surface being configured to underlie and engage the inner part of the tragus of the user's ear in the installed position, and being configured to cooperate with the first outwardly protruding abutment to restrict rotation of the earbud in the user's ear and to prevent the earbud from falling out of the user's ear after the earbud is in the installed position.

12. A wireless earbud for engaging and acoustically communicating with a user's ear, the earbud comprising:

a housing having an inner portion and an outer portion opposite the inner portion;

the inner portion having an inwardly facing ovate-shaped surface having an ovate-shaped perimeter, the ovate-shaped surface having a narrower forward end portion configured to fit toward the user's ear canal, and a wider rearward end portion opposite the forward end portion, the rearward end portion being configured to fit in the concha of the user's ear;

wherein the inwardly facing ovate-shaped surface has an audio cone extending inwardly toward the ear canal, the audio cone having an audio port for transmitting audible sound therethrough, wherein an apex of the audio cone is disposed proximal a focal point of an ellipse superimposedly inscribed within the ovate-shaped perimeter, the superimposedly inscribed ellipse having a major axis aligned with the major axis of the ovate-shaped surface, the apex of the audio cone being disposed proximal the focal point of the superimposedly inscribed ellipse that is closer to the forward end portion of the ovate-shaped surface; and wherein the superimposedly inscribed ellipse has an eccentricity of between 0.4 and 0.7, and wherein the apex of the audio cone is disposed on the major axis between the center of the superimposedly inscribed ellipse and the focal point of the superimposedly inscribed ellipse.

13. The wireless earbud according to claim 12, wherein the audio cone has an axis that is perpendicular to a major axis which is generally parallel to the side of the user's face when the earbud is in the installed position.

14. The wireless earbud according to claim 12, wherein the outer portion has an outwardly facing surface opposite the inwardly facing surface, wherein the earbud further comprises a plurality ridges extending outwardly from the outwardly facing surface to define an outward protuberance having a polygonal perimeter.

15. The wireless earbud according to claim 12, wherein the outer portion has an outwardly facing surface opposite the inwardly facing surface, wherein the earbud further comprises a multi-faceted crown protruding outwardly from the outwardly facing surface, wherein the facets of the crown are sloped relative to a central region of the crown and terminate at respective abutment surfaces, the respective abutment surfaces being configured to restrict movement of the earbud in the installed position.

16. A wireless earbud for engaging and acoustically communicating with a user's ear, the earbud comprising:

a generally flattened ovoid-shaped body;

a cone-shaped protrusion extending outwardly from one side of the generally flattened ovoid-shaped body; and a multi-faceted crown protruding outwardly from the opposite side of the generally flattened ovoid-shaped body;

wherein the multi-faceted crown has a first outwardly protruding abutment and second outwardly protruding abutment, the first abutment connecting with the second abutment to define a convex abutment surface that is configured to fit within the user's intertragical notch when the earbud is in an installed position.

17. The wireless earbud according to claim 16, wherein the generally flattened ovoid-shaped body has a narrower forward end portion configured to fit toward the user's ear canal, and a wider rearward end portion opposite the forward end portion, the rearward end portion being configured to fit in the concha of the user's ear; and wherein the generally flattened ovoid-shaped body has a principal axis extending across the forward end portion and the rearward end portion; and wherein the cone-shaped protrusion is offset from the multi-faceted crown in a forward direction along the principal axis.

18. The wireless earbud according to claim 16, wherein the cone-shaped protrusion includes an audio conduit and an audio port for transmitting audible sound.

19. The wireless earbud according to claim 16, wherein the multi-faceted crown has a flat plateau, and wherein the respective facets slope from the plateau toward the generally flattened ovoid-shaped body and terminate at respective abutment surfaces, the respective abutment surfaces being configured to restrict movement of the earbud in the installed position.

20. The wireless earbud according to claim 16, wherein the convex abutment surface is V-shaped.

* * * * *